252-103 AU 157 EX
4/17/84 OR 4,443,353

United States Patent [19]

Van Paassen

[11] 4,443,353

[45] Apr. 17, 1984

[54] AQUEOUS BLEACHING AGENT WITH CLEANING ACTION

[75] Inventor: Nicolaas A. I. Van Paassen, Bodegraven, Netherlands

[73] Assignee: Chem-Y Fabriek Van Chemische Producten B.V., Bodegraven, Netherlands

102

[21] Appl. No.: 404,652

[22] Filed: Aug. 3, 1982

[30] Foreign Application Priority Data

Aug. 15, 1981 [NL] Netherlands ..... 8103829

[51] Int. Cl.[3] ..... C11D 1/06; C11D 3/395; C11D 17/08

[52] U.S. Cl. ..... 252/103; 252/89.1; 252/95; 252/99; 252/174.21; 252/DIG. 6

[58] Field of Search ..... 252/94, 95, 103, 99, 252/DIG. 6

[56] References Cited

U.S. PATENT DOCUMENTS 2,870,220 1/1959 Carter ..... 252/351
3,758,409 9/1973 Koshigaya et al. ..... 252/95 X
3,941,710 3/1976 Gilbert et al. ..... 252/99

FOREIGN PATENT DOCUMENTS 2160409 6/1972 Fed. Rep. of Germany .
2458100 12/1975 Fed. Rep. of Germany .
159709 12/1971 Netherlands .
1378649 12/1974 United Kingdom .

OTHER PUBLICATIONS

B. Levitt, Oils, Detergents and Maintenance Specialties, vol. 1, Chemical Publishing Co. Inc., New York, 1967.

*Primary Examiner*—Dennis L. Albrecht
*Assistant Examiner*—Mukund J. Shah

[57] ABSTRACT

The invention relates to an aqueous bleaching agent with cleaning action, containing an alkali metal hypochlorite, an alkaline agent, and one or more compounds of the general formula $R\text{-}(OCH_2CH_2)_xOCH_2COOM$, where R represents an alkyl group with 8–18 carbon atoms, x a number with an average value of 0.5–8 and a narrow distribution of the average value and M an alkali metal atom.

9 Claims, No Drawings

AQUEOUS BLEACHING AGENT WITH CLEANING ACTION

The invention relates to an aqueous bleaching agent with cleaning action on the basis of an alkali metal hypochlorite and a surface-active substance.

Aqueous solutions containing alkali metal hypochlorite are commercially available and are used as bleaching and cleaning agents, mostly in a concentration of 5–15% by weight active chlorine. The cleaning action of such a bleaching and cleaning agent can be improved substantially by adding surface-active substances. Thus, a more viscous solution is obtained, so that a better contact is obtained between the bleaching and cleaning agent and the surface to be cleaned.

According to Dutch patent specification No. 159,709 a suitable bleaching and cleaning agent can be obtained by taking up in water an alkali metal hypochlorite and a surface-active substance and an alkaline agent, using as surface-active substance a compound of the general formula $R—C_6—H_4—O(CH_2CH_2O)_n(CH_2)_m—COOM$, where R represents an alkyl group with 8–22 carbon atoms, n a whole number of 1–40, m 1 or 2 and M an alkali metal atom.

A disadvantage of these surface-active substances is their poor biodegradability.

Now a group of surface-active substances has been found which, in combination with an alkali metal hypochlorite and an alkaline agent, have a good viscosity-increasing action and good biodegradability. The aqueous bleaching agent with cleaning action according to the invention, containing an alkali metal hypochlorite, a surface-active substance and an alkali agent, is characterized in that as surface-active substance use is made of one or more compounds of the general formula $R—(OCH_2CH_2)_xOCH_2COOM$, where R represents an alkyl group with 8–18 carbon atoms, x a number with an average value of 0.5–8 and a narrow distribution of the average value and M an alkali metal atom, in a total quantity of 0.1–30 grams per 100 grams of alkali metal hypochlorite in the aqueous bleaching agent.

By preference, use is made of one or more compounds of said general formula, in which R represents an alkyl group with 10–16 carbon atoms and x a number having an average value of 2.5–5.5, in a total quantity of 0.3–15 grams per 100 grams of alkali metal hypochlorite in the aqueous bleaching agent. If desired, besides the surface-active substance according to the invention a quantity of another surface-active substance can be used. A suitable mixture of surface-active substances is obtained, for instance, if 10–20 grams of the abovementioned surface-active substance according to Dutch patent specification No. 159,709 is used per 100 grams of surface-active substance according to the invention. Such a mixture satisfies the usual biodegradability standards but has a higher viscosity-increasing action than an equal quantity of each of the individual components under otherwise identical conditions.

The bleaching agent according to the invention can be prepared by adding to an aqueous solution of an alkali metal hypochlorite, with a concentration of for instance 15% by weight active chlorine, the desired quantity of surface-active substance and alkaline agent and diluting the mixture with water to the desired concentration. Aqueous solutions of alkali metal hypochlorite are commercially available in various concentrations, for instance, in a concentration of 10 grams of active chlorine per 100 ml, under the name of bleaching water.

In the bleaching agent according to the invention various alkaline agents may be applied, for instance salts of strong bases with weak acids. By preference, an alkali metal hydroxyde is used as alkaline agent. The quantity of alkaline agent to be used may vary, for instance a quantity of 0.1–10 grams per 100 grams alkali metal hypochlorite in the aqueous bleaching agent. By preference a quantity of alkaline agent of 0.5–5 grams is used per 100 grams alkali metal hypochlorite in the aqueous bleaching agent.

The quantity of water in the bleaching agent according to the invention may also vary, and can for instance be chosen so that a concentration of dissolved substances of in total 5–35% by weight, by preference 10–30% by weight, is obtained.

The surface-active substance according to the invention with a narrow distribution of the average number of oxyethylene units can be prepared in a known way by converting an alcohol ROH, in which formula R corresponds with the R group in the desired surface-active compound, with ethylene oxide under the influence of an acid catalyst, such as, for instance, $BF_3$, and $SbCl_5$ (see U.S. Pat. No. 2,870,220), into ethoxylated alcohol. Ethylene oxide may be reacted with a branched-chain or straight-chain higher secondary alcohol, and preferably one having the hydroxyl group attached to a carbon atom at or near the middle of the carbon chain, in the presence of an acidic catalyst. The acidic catalyst used in this process conveniently can be one of the well known class of Friedel-Crafts type reaction catalysts, such as the fluorides and chlorides of boron, aluminum, iron, tin and titanium, and complexes of such halides and ethyl ether. Sulfuric acid and phosphoric acid also are effective.

Preferably the ethylene oxide is slowly added during several hours to an agitated body of the secondary alcohol having from 0.02% to 0.05% or more of its weight of the acidic catalyst present therein, within a fluid-tight reactor, while maintaining the reaction mixture at a temperature within the range from 0° C. to 80° C., and preferably at about 50° C., and at pressures from around atmospheric to 50 p.s.i. gauge. This reaction is continued until all of the ethylene oxide added has reacted with the alcohol. A stream of the ethylene oxide is passed into the alcohol and reacted therewith in a molar ratio within the range from 0.2:1 to 4:1; and preferably from 0.8:1 to 1.5:1. The obtained product with the desired narrow distribution is subsequently converted in a known way, for instance according to the Williamson synthesis, into the acid in question of the general formula $R—(OCH_2CH_2)_xOCH_2COOH$, upon which the surface-active substance according to the invention can be formed from this acid with a base MOH. The surface-active substances according to the invention, as well as the acid form thereof, are known, commercially available surface-active substances.

In the following examples the invention will be elucidated.

EXAMPLE I

To an aqueous bleaching lye of commercial quality with 15% by weight active chlorine (the chlorine in hypochlorite), which was meanwhile being stirred, sodium hydroxide (50% by weight), water and surface-active substance were added in such quantities that the desired concentrations in the final product were obtained.

As surface-active substance use is made of R—$(OCH_2CH_2)_{3,8}OCH_2COOH$ with a narrow distribution, R representing a $C_{12}$–$C_{13}$ alkyl group, which surface-active substance is commercially available under the name of Akypo 23 Q 38 (registered trademark). By using more than one mole NaOH per mole of the surface-active substance, the surface-active substance is neutralised to the Na compound in question. An aqueous bleaching agent is obtained with 10% by weight active chlorine, 2% by weight sodium hydroxyde (50% by weight) and 2% by weight R—$(OCH_2CH_2)_{3,8}OCH_2COONa$. The viscosity of this product at 20° C. is 55 cp (measured with Brookfield viscosimeter). After 4 weeks' storage of the product at 35° C. it is found that the viscosity has retained its original value, while the active chlorine content has decreased no further than to 5.74% by weight.

COMPARATIVE EXAMPLE

In the same way as in Example I an aqueous bleaching agent is prepared, there being a difference, however, in that a surface-active substance with a broad distribution of the average number of oxyethylene units is started from. As such, use is made of the product commercially available under the name of Akypo RLM 45 N (registered trademark) of the formula $R(OCH_2—CH_2)_{4,5}OCH_2COONa$, where R represents a $C_{12}$–$C_{14}$ alkyl group.

For the preparation of such a surface-active substance the ethoxylated alcohol in question, that is obtained by ethoxylation with the aid of an alkaline catalyst, is used as starting product.

The viscosity at 20° C. of the bleaching agent obtained is only 2–3 cp.

EXAMPLE II

In the same way as in Example I an aqueous bleaching agent is prepared, starting from an other surface-active substance, which is different in that R represents a $C_{12}$–$C_{14}$ alkyl group (70% by weight $C_{12}$ and 30% by weight $C_{14}$). This surface-active substance is commercially available under the name of Akypo RLMQ 38 (registered trademark). The product obtained contains, besides 10% by weight active chlorine and 2% by weight sodium hydroxyde (50% by weight), 3% by weight of the surface-active substance as Na compound. The viscosity at 20° C. of the product is 150 cp. After 4 weeks' storage of the product at 35° C. it is found that the viscosity has retained its original value, while the active chlorine content has decreased no further than to 5.77% by weight.

EXAMPLE III

In the same way as in Example I an aqueous bleaching agent is prepared in which part of the surface-active substance is replaced by another surface-active substance. A product is obtained which, besides 10% by weight active chlorine and 2% by weight sodium hydroxyde (50% by weight), contains 1.7% by weight of the surface-active substance mentioned in Example I and 0.3% by weight $C_9H_{19}—C_6H_4—(CH_2CH_2O)_4—CH_2COONa$. The latter compound is obtained by starting from the corresponding acid, which is commercially available under the name of Akypo NP 40 (registered trademark). The viscosity at 20° C. of the product is 70 cp. After 4 weeks' storage of the product at 35° C. it is found that the viscosity has retained its original value and the active chlorine content is 5.96% by weight.

I claim:

1. An aqueous bleaching agent having increased viscosity and having cleaning action composed of an alkali metal hypochlorite, at least one surfactant and an alkali metal hydroxide wherein 0.1 to 30 grams of said surfactant are present per 100 grams of said alkali metal hypochlorite and said surfactant is selected from compounds having the general formula $R—(OCH_2CH_2)_xOCH_2COOM$, wherein said formula R represents an alkyl group having from 8 to 18 carbon atoms, x is a number representing a narrow distribution of the average number of oxyethylene units and having an average value of 0.5 to 8 and M represents an alkali metal atom, wherein said compounds having an narrow distribution of the average number of oxyethylene units are derived from an ethoxylated alcohol obtained by reacting an alcohol with ethylene oxide under the influence of a Friedel-Crafts type acid catalyst, said alcohol having the formula ROH wherein R represents an alkyl group having from 8 to 18 carbon atoms.

2. An aqueous bleaching agent having increased viscosity and having cleaning action composed of an alkali metal hypochlorite, at least one surfactant and an alkali metal hydroxide wherein 0.1 to 30 grams of said surfactant are present per 100 grams of said alkali metal hypochlorite and said surfactant is selected from compounds having the general formula $R—(OCH_2CH_2)_xOCH_2COOM$, wherein said formula R represents an alkyl group having from 8 to 18 carbon atoms, x is a number representing a narrow distribution of the average number of oxyethylene units and having an average value of 0.5 to 8 and M represents an alkali metal atom, wherein said compounds having an narrow distribution of the average number of oxyethylene units are derived from an ethoxylated alcohol obtained by reacting an alcohol with ethylene oxide under the influence of a sulfuric or phosphoric acid catalyst, said alcohol having the formula ROH wherein R represents an alkyl group having from 8 to 18 carbon atoms.

3. An aqueous bleaching agent according to claim 1 or 2 wherein said bleaching agent contains 0.5 to 5 grams of said alkaline agent per 100 grams of said alkali metal hypochlorite.

4. An aqueous bleaching agent according to claim 1 or 2 wherein the concentration of dissolved substances in said bleaching agent is 10 to 30 percent by weight.

5. An aqueous bleaching agent according to claim 1 or 2 wherein said general formula R is an alkyl group having 10 to 16 carbon atoms, x is a number having a narrow average distribution and an average value of 2.5 to 5.5 and said bleaching agent contains 0.3 to 15 grams of said surfactant per 100 grams of said alkali metal hypochlorite.

6. An aqueous bleaching agent according to claim 1 or 2, wherein said bleaching agent further includes:

(a) 0.5 to 5 grams of said alkaline agent per 100 grams of said alkali metal hypochlorite;

(b) said surfactant wherein said general formula R is an alkyl group having 10 to 16 carbon atoms and x is an average value of 2.5 to 5.5; and (c) 0.3 to 15 grams of said surfactant per 100 grams of said alkali metal hypochlorite.

7. An aqueous bleaching agent according to claim 1, 3, 4, 5, 6 or 2 wherein said bleaching agent contains 10 to 20 grams of a compound having the general formula $RC_6H_4—O(CH_2CH_2O)_n(CH_2)_m—COOM$ per 100 grams of said surfactant wherein R represents an alkyl group having 8 to 22 carbon atoms, n is a whole number from 1 to 40, m is 1 or 2 and M represents an alkali metal atom.

8. An aqueous bleaching agent according to claim 1 wherein said catalyst is selected from the group consisting of $BF_3$ and $SbCl_5$.

9. An aqueous bleaching agent according to claim 1 wherein said catalyst is a: (i) fluoride and/or chloride of boron, aluminum, iron, tin or titanium or (ii) complex of a fluoride and/or chloride of boron, aluminum, iron, tin or titanium with ethyl ether.

* * * * *